United States Patent [19]

Gage

[11] 4,094,253

[45] June 13, 1978

[54] RAILWAY TRUCK FLOATING PEDESTAL WEAR LINER

[75] Inventor: Paul E. Gage, Wyomissing, Pa.

[73] Assignee: The Polymer Corporation, Reading, Pa.

[21] Appl. No.: 708,661

[22] Filed: Jul. 26, 1976

[51] Int. Cl.[2] ..... B61F 5/30; B61F 5/50; B61F 17/36; F16C 33/20

[52] U.S. Cl. ..... 105/225; 105/221 R; 308/238

[58] Field of Search ..... 105/221, 225; 308/238

[56] References Cited

U.S. PATENT DOCUMENTS

| | | | |
|---|---|---|---|
| 1,866,264 | 7/1932 | Melcher | 105/225 X |
| 1,903,859 | 4/1933 | Glascodine | 105/225 |
| 2,474,008 | 6/1949 | Meyer | 105/225 |
| 3,378,317 | 4/1968 | Fisher et al. | 105/225 X |
| 3,554,618 | 1/1971 | Ditzler et al. | 105/225 |
| 4,001,124 | 1/1977 | Hussey | 105/225 X |

*Primary Examiner*—Drayton E. Hoffman
*Assistant Examiner*—Howard Beltran
*Attorney, Agent, or Firm*—M. Richard Page

[57] ABSTRACT

A pedestal liner for railroad trucks is disclosed in which the liner is not bolted to the pedestal leg, but instead is allowed to "float" — that is, to move relative both to the journal box and to the pedestal leg.

4 Claims, 3 Drawing Figures

FIG. 1
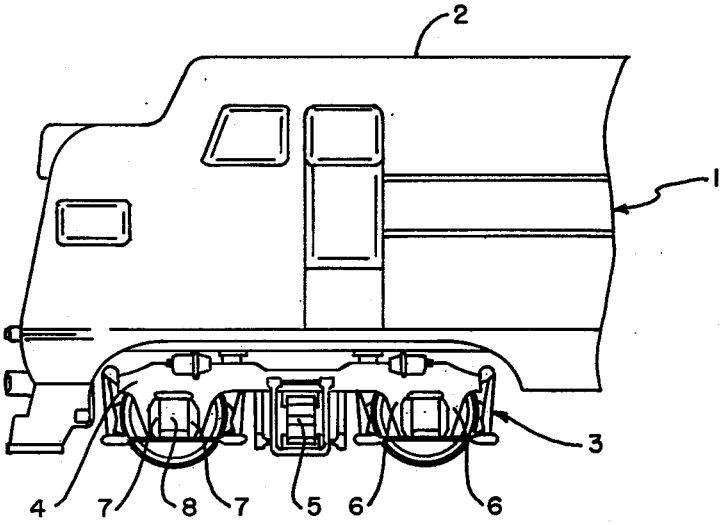
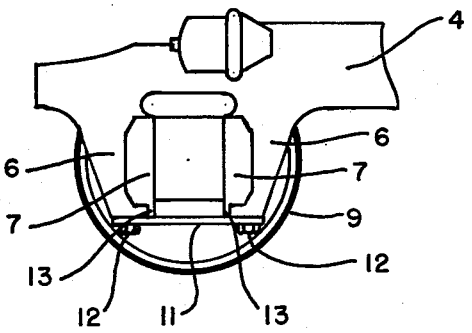
FIG. 2
FIG. 3
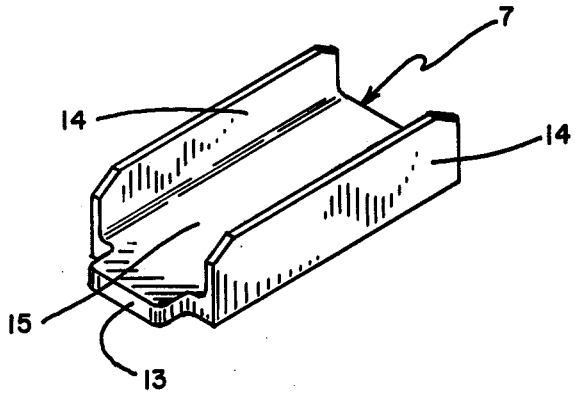

RAILWAY TRUCK FLOATING PEDESTAL WEAR LINER

BACKGROUND OF THE INVENTION

1. Field of the Invention

This invention relates to improvements in trucks for railroad locomotives and cars and, more particularly, to improved pedestal liners that form bearing surfaces for those portions of the trucks that are slidably engaged to enable the wheels and body of the locomotive car to move relative to each other in a generally vertical direction. More particularly, this invention relates to an improved pedestal liner that is not secured to the pedestal leg, but instead is permitted to "float" relative both to the pedestal leg and the journal box.

2. Description of the Prior Art

The truck upon which a railroad locomotive or car body is supported is comprised essentially of two side frames tied together by a transverse piece called the "bolster." One type of truck commonly used for locomotives is referred to as a "pedestal truck". The pedestals are part of the side frames and are formed in inverted "U"-shaped sections that horizontally position and hold the journal box while permitting the journal box to move essentially vertically in relationship to the truck. The two projections that comprise the "U" of the pedestal are called the ‡pedestal legs" and the space between them the "jaw". The jaw is closed at the bottom when the journal box is inserted by means of a pedestal tie bar. In this arrangement, the journal box is held positioned in vertical sliding relationship with the truck and, since the locomotive body is supported by the bolster and side frames, vertical movement between the locomotive body and the journal box, journal and wheels is permitted.

As considerable wear takes place at the engaging faces of the pedestal and the journal box, it is common practice to attach wear plates to both the pedestal legs and the journal boxes. The former are referred to as "pedestal liners" and the latter as "journal box wear plates." Conventionally, the journal box wear plate is attached to the journal box by welding, whereas the pedestal liner is removably mounted as by bolting onto the pedestal legs.

Until recent years, the wear plates conventionally have been manufactured of hardened high-carbon spring steel or other alloy steel such as magnesium steel. More recently, however, it has been found that more satisfactory performance can be obtained utilizing wear plates made from some of the tougher plastics such as nylons, polyacetals, polyurethanes, polyolefins, polycarbonates, polyesters, rigid polyvinyls, polyethers, polysulfones, polyimides, polyamidimides, polysilcones, and the like. As is disclosed in U.S. Pat. No. 3,554,618, these plastic materials may be used to form a generally "U"-shaped wear plate that can be bolted onto the pedestal leg of a railroad truck.

Plastic pedestal liners gained almost immediate acceptance throughout the industry due to the fact that they outwear alloy steel liners and thus require less frequent replacement. Further, they are advantageous in that they reduce the wear on the journal box wear plate. This is of considerable advantage since when the wear plate on the journal box becomes unduly worn, the welds must be broken and a new plate welded in its place.

While plastic pedestal liners have, by and large, proven considerably more satisfactory in use than the steel alloy liners, they do sometimes fail by cracking at those points where they are bolted onto the pedestal. It is believed that under conditions of heavy use, stress crazing may embrittle the plastic and cause it to break at the bolts where it is secured to the pedestal leg.

It has been conventional to bolt the pedestal liner to the pedestal leg and, indeed, it has always been thought necessary to do so, particularly with respect to steel pedestal liners. If the steel liners are not fastened to the pedestal leg, either by bolting or by welding, they tend to wear the mating cast steel pedestal legs rapidly, which then have to be rebuilt or replaced; if not secured, the liners may hang up, with resulting damage to liners and mating parts; and they will, if not secured, cause pounding and fatigue on the journal boxes, and further may cause excessive noise from loose parts in metal-to-metal contact.

SUMMARY OF THE INVENTION

It has now been found that when plastic pedestal liners are used, it is not necessary to secure them to the pedestal legs. Surprisingly, plastic pedestal liners operate quite satisfactorily when they are allowed to "float'-'—i.e., move relative both to the journal box and the pedestal leg. Not only do they not display any inordinate amount of wear substantially different from other plastic pedestal liners that are bolted in place, but further, they are not subject to stress crazing and breakage at points where they otherwise would be bolted to the pedestal leg.

Not only is the floating pedestal liner advantageous in preventing breakage at bolt holes, but it greatly simplifies and reduces the expense of installing new pedestal liners. When conventional Huck bolts are used to bolt the liner to the leg, it is necessary to destroy the bolt when it is removed. The total cost of pins and collars required for a single liner at today's prices is about $6, and as the bolts must be replaced with each installation, this is a recurring cost. The total bolt cost for replacing all liners during truck overhaul would be $96; for a four-axle locomotive and $144 for a six-axle locomotive. The time required to remove old bolts and to install new bolts is estimated at about 15 minutes per liner, which is a labor cost of about $1.50 per liner based on $6 per hour shop rate. Thus, the total cost of removing and replacing all bolts during liner renewal and truck overhaul is upwards of $150, which can be saved by utilizing the floating plastic liners of the instant invention.

It is the object of this invention to provide improved pedestal liners that make it unnecessary to bolt or otherwise secure the liner to the pedestal leg when a replacement is made.

Briefly, these and other objects of this invention are achieved by the simple procedure of fabricating plastic pedestal liners that are free to float on the pedestal leg—a movement relative both to the journal box and the pedestal leg.

DESCRIPTION OF THE DRAWINGS

FIG. 1 is a somewhat schematic representation of a side view of a portion of a railroad locomotive;

FIG. 2 is an enlarged view, partially broken away, of the side frame of a pedestal truck; and FIG. 3 is a perspective view of a pedestal liner constructed in accordance with this invention.

In FIG. 1 there is generally shown a portion of the front end of a railroad locomotive 1. Essentially, the locomotive is comprised of a car body or cab 2 supported on a truck generally shown at 3. The mounting of the locomotive cab 2 on the truck 3 includes springs 5 mounted in the side frame 4 of the truck. As can best be seen with reference to FIG. 2, the truck 3 is of the pedestal tupe—that is, the side frame 4 carries a pedestal defined by the depending pedestal legs 6. Mounted directly upon the pedestal legs 6 are pedestal liners 7. The pedestal liners 17 define the inside surfaces of the jaws of the side frame 4, which jaws are adapted to receive in vertical sliding relationship the journal box 8 which in turn serves as a bearing for the axle (not shown) that secures the wheels 9 for rotation.

The pedestal liner 7 is shown in FIG. 3 as having a generally "U"-shaped configuration with a base 15 and two side walls 14. Depending from one end of the base 15 is a land 13. The pedestal liner 7 is installed on the pedestal leg 6 as shown in FIG. 2 with the land 3 in the downward position. The pedestal liners 7 are secured in position by means of the tie bar 11 that closes the jaws of side frame 4 when the tie bar 11 is bolted in position by fasteners 12. Thus, it can be seen that the liner 7 is supported at its base by tie bar 11 and is held vertically positioned by the journal box 8 on the one side and the pedestal leg 6 on the other side. Since the pedestal liner is not secured by bolts, it is permitted to slide or float relative to the journal box 8 and the pedestal legs 6. By these means, the pedestal liner is not subject to being broken adjacent the bolts, and it can readily be replaced without destroying the old bolts and inserting new ones.

I claim:

1. In a pedestal truck for railroad locomotives including:

a pair of spaced-apart, vertically-disposed pedestal legs that define a jaw open at its lower end;

a journal box mounted within the jaw in vertical sliding relationship to the pedestal legs;

a pedestal tie bar extending between the ends of the pedestal legs closing the lower end of the jaw;

generally channel-shaped pedestal liners made from tough, wear-resistant plastic mounted on each of the pedestal legs with the bight of the channels facing the journal box and interposed as bearing surfaces between the journal box and the pedestal legs and with the sides of the channels extending over a portion of the side faces of the pedestal legs; the improvement comprising mounting the pedestal liners in sliding frictional engagement with the journal box on one side and the pedestal legs on the other side.

2. A pedestal liner according to claim 1 wherein the tough plastic is at least one of nylon, polyester, polyacetal, polyolefin and polymide.

3. A pedestal liner according to claim 1 wherein the pedestal liners are supported on, and the lower extent of their vertical movement is restricted by, the pedestal tie bar.

4. A pedestal liner according to claim 3 wherein a land is provided on the bottom portion of the pedestal liner to rest on the pedestal leg tie bar.

* * * * *